US009055772B2

(12) United States Patent
Stinson et al.

(10) Patent No.: US 9,055,772 B2
(45) **Date of Patent: *Jun. 16, 2015**

(54) EXPLOSION SAFETY GARMENT

(76) Inventors: Brenda Stinson, Cataldo, ID (US); Larry Stinson, Cataldo, CA (US)

( * ) Notice: Subject to any disclaimer, the term of this patent is extended or adjusted under 35 U.S.C. 154(b) by 205 days.

This patent is subject to a terminal disclaimer.

(21) Appl. No.: 12/586,663

(22) Filed: Sep. 25, 2009

(65) Prior Publication Data

US 2010/0011490 A1 Jan. 21, 2010

Related U.S. Application Data

(63) Continuation of application No. 11/104,792, filed on Apr. 13, 2005, now Pat. No. 7,594,281.

(60) Provisional application No. 60/562,449, filed on Apr. 14, 2004.

(51) Int. Cl.
*A62B 17/00* (2006.01)
*A41D 13/00* (2006.01)

(52) U.S. Cl.
CPC ..... *A41D 13/0007* (2013.01); *A62B 17/003* (2013.01)

(58) Field of Classification Search
CPC ..... A41D 31/0022; A41D 31/0027; A41D 31/0033; A41D 31/0038; A62B 17/003; A62B 17/00; A62B 35/00; A62B 35/0006; A62B 35/0012; A62B 35/0018; A62B 35/0025; A62B 35/0037
USPC ..... 2/84, 94, 81, 93, 96, 97, 98, 100, 455, 2/456, 457, 458
See application file for complete search history.

(56) References Cited

U.S. PATENT DOCUMENTS

| | | | | | |
|---|---|---|---|---|---|
| 1,845,099 | A | * | 2/1932 | Popelakova et al. | 244/143 |
| 2,709,667 | A | * | 5/1955 | Grubb et al. | 442/118 |
| 2,773,262 | A | * | 12/1956 | Brouha et al. | 2/81 |
| 2,887,286 | A | * | 5/1959 | Moran | 244/143 |
| 2,979,153 | A | * | 4/1961 | Hoagland et al. | 182/3 |
| 3,424,134 | A | * | 1/1969 | Rosenblum | 182/3 |
| 3,498,408 | A | * | 3/1970 | Foote | 182/6 |
| 3,973,643 | A | * | 8/1976 | Hutchinson | 182/3 |
| 4,034,417 | A | * | 7/1977 | Ellis | 2/81 |
| 4,273,216 | A | * | 6/1981 | Weissmann | 182/3 |
| 4,573,217 | A | * | 3/1986 | Reed | 2/7 |
| 4,602,385 | A | * | 7/1986 | Warren | 2/2.14 |
| 4,625,335 | A | * | 12/1986 | Vinai | 2/69 |
| 4,682,671 | A | * | 7/1987 | Hengstenberger et al. | 182/3 |

(Continued)

OTHER PUBLICATIONS

"Technical Guide for Nomex® Brand Fiber", pub. E.I. du Pont de Nemours & Co. (Jul. 2001).

(Continued)

*Primary Examiner* — Alissa L Hoey
(74) *Attorney, Agent, or Firm* — Duncan Palmatier

(57) ABSTRACT

A retrievable flash suit designed to protect the wearer from injury due to explosion and flame, and to allow retrieval of the wearer by others in case of unconsciousness of the wearer. The device consists of a suit and a hood. The suit consists of an outer layer of flame resistant material and an inner layer, also of flame resistant material. Sewn to the inside of the suit is a one piece harness. The detached hood consists of a three layer hood of flame resistant material with a neck drape of one layer of flame resistant material and a protected face opening of two layers of flame resistant material.

10 Claims, 14 Drawing Sheets

(56) References Cited

U.S. PATENT DOCUMENTS

| | | | | | |
|---|---|---|---|---|---|
| 4,731,882 | A * | 3/1988 | Ekman | 2/69 |
| 4,854,418 | A * | 8/1989 | Hengstenberger et al. | 182/3 |
| 4,860,382 | A * | 8/1989 | Markwell | 2/457 |
| 4,890,336 | A * | 1/1990 | Worton | 2/79 |
| 5,109,549 | A * | 5/1992 | Mattinson | 2/202 |
| 5,163,183 | A * | 11/1992 | Smith | 2/81 |
| 5,172,426 | A * | 12/1992 | Capello | 2/81 |
| 5,182,812 | A * | 2/1993 | Goldsby | 2/79 |
| 5,188,267 | A * | 2/1993 | Sargent et al. | 2/95 |
| 5,274,850 | A * | 1/1994 | Aldridge | 2/84 |
| 5,297,295 | A * | 3/1994 | Barbeau et al. | 2/96 |
| 5,628,065 | A * | 5/1997 | Austin | 2/81 |
| 5,860,163 | A * | 1/1999 | Aldridge | 2/81 |
| 5,873,132 | A * | 2/1999 | Grilliot et al. | 2/84 |
| 5,918,314 | A * | 7/1999 | Moses | 2/79 |
| 5,960,475 | A * | 10/1999 | Fewtrell | 2/82 |
| 5,960,480 | A * | 10/1999 | Neustater et al. | 2/456 |
| 5,970,517 | A * | 10/1999 | Jordan | 2/69 |
| 6,006,360 | A * | 12/1999 | Reed | 2/202 |
| 6,101,631 | A * | 8/2000 | Ferguson, Jr. | 2/94 |
| 6,128,782 | A * | 10/2000 | Young et al. | 2/69 |
| 6,205,584 | B1 * | 3/2001 | Yocco | 2/69 |
| 6,233,740 | B1 * | 5/2001 | Meyers et al. | 2/102 |
| 6,256,789 | B1 * | 7/2001 | Young et al. | 2/69 |
| 6,296,023 | B1 * | 10/2001 | Gehrhardt et al. | 139/420 A |
| 6,370,692 | B1 * | 4/2002 | Duyn et al. | 2/86 |
| 6,374,946 | B1 * | 4/2002 | Petzl et al. | 182/6 |
| 6,490,733 | B1 * | 12/2002 | Casaubon | 2/81 |
| 6,499,149 | B2 * | 12/2002 | Ashline | 2/468 |
| 6,658,666 | B2 * | 12/2003 | Schweer | 2/94 |
| 6,662,372 | B2 * | 12/2003 | Lewis et al. | 2/69 |
| 6,698,026 | B2 * | 3/2004 | Schweer | 2/94 |
| 6,766,534 | B2 * | 7/2004 | Lewis et al. | 2/84 |
| 6,782,556 | B2 * | 8/2004 | Grilliot et al. | 2/202 |
| 6,813,782 | B2 * | 11/2004 | Kintzi et al. | 2/421 |
| 6,829,784 | B2 * | 12/2004 | Austin | 2/7 |
| 6,839,909 | B1 * | 1/2005 | Prince | 2/81 |
| 6,871,360 | B1 * | 3/2005 | Ashline | 2/468 |
| 6,892,395 | B2 * | 5/2005 | Schweer | 2/94 |
| 7,025,171 | B2 * | 4/2006 | Cox | 182/3 |
| 7,036,628 | B2 * | 5/2006 | Wilcox et al. | 182/9 |
| 7,047,567 | B2 * | 5/2006 | Allen | 2/69 |
| 7,086,091 | B2 * | 8/2006 | Jordan | 2/69 |
| 7,168,103 | B2 * | 1/2007 | Aldridge et al. | 2/458 |
| 7,356,850 | B2 * | 4/2008 | Turcotte et al. | 2/69 |
| 7,594,281 | B1 * | 9/2009 | Stinson et al. | 2/456 |
| 7,665,153 | B2 * | 2/2010 | Grilliot et al. | 2/69 |
| 7,971,273 | B2 * | 7/2011 | Grilliot et al. | 2/81 |
| 7,987,521 | B2 * | 8/2011 | Vereen | 2/81 |
| 2003/0196246 | A1 * | 10/2003 | Schweer | 2/94 |
| 2003/0213043 | A1 * | 11/2003 | Lewis et al. | 2/69 |
| 2004/0128734 | A1 * | 7/2004 | Jordan | 2/69 |
| 2004/0140152 | A1 * | 7/2004 | Richardson | 182/3 |
| 2007/0192926 | A1 * | 8/2007 | Fee et al. | 2/81 |

OTHER PUBLICATIONS

Cht. 4 ("Textiles"), from "Fire Retardant Materials" (ed. A.R. Horrocks and D. Price), pub. E.I. du Pont de Nemours & Co. (Feb. 2001).

* cited by examiner

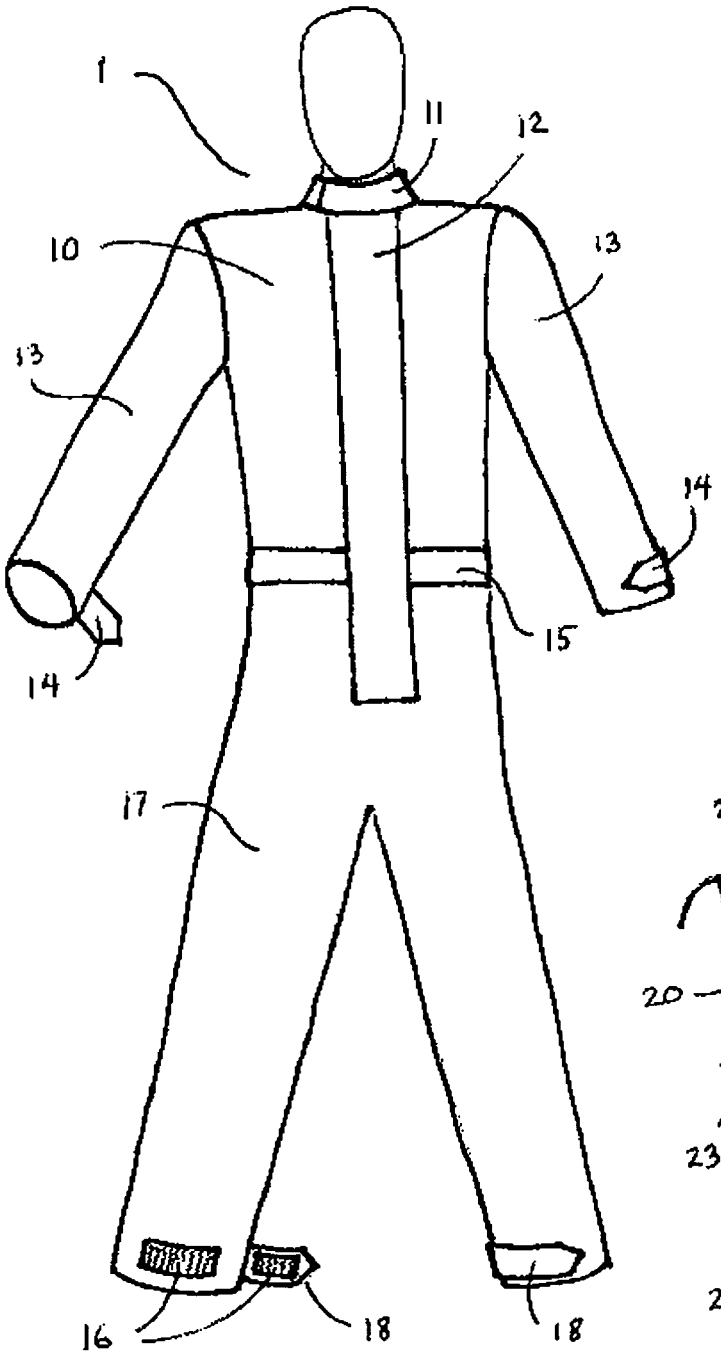
Fig. 1a
Fig. 1b
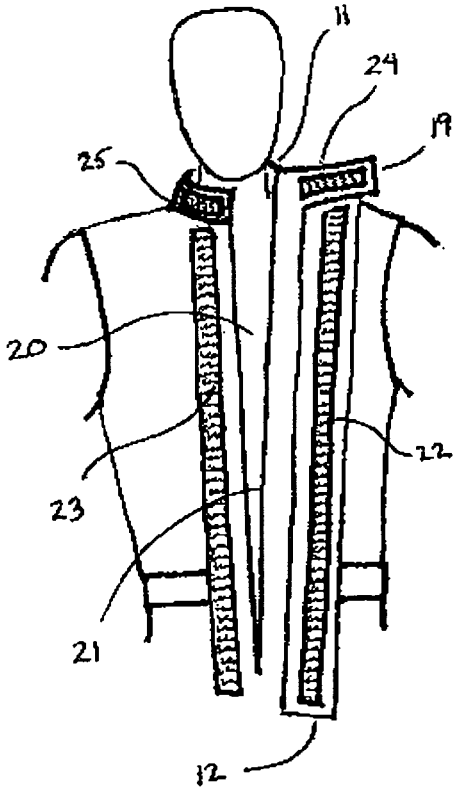

Fig. 11
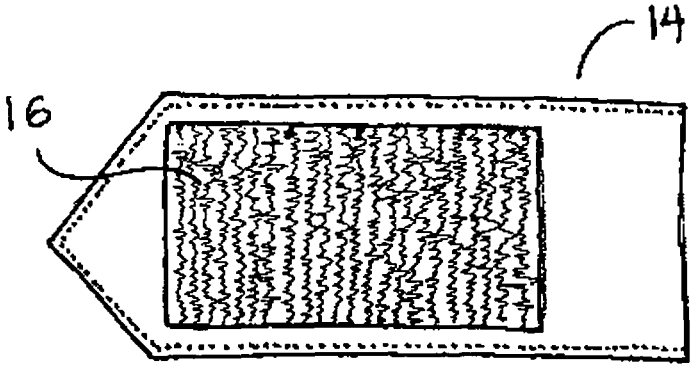
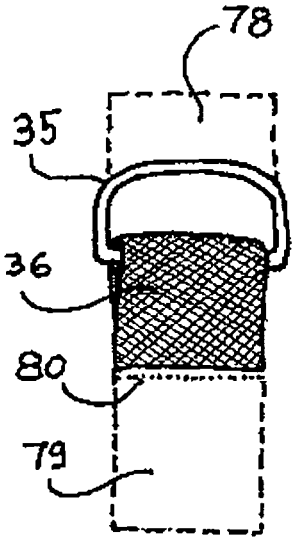
Fig. 12a
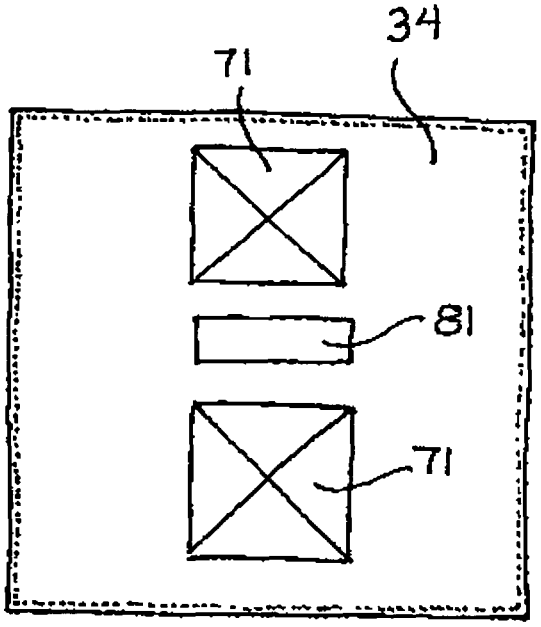
Fig. 12b

| Burn # | Garment Description | Exp. Time (sec) | Burn Injury (2nd/3rd/Total) | Comments |
|---|---|---|---|---|
| 1 | Nude Burn | 4.0 | 0/100/100 | Heat Flux: 1.70 cal/cm$^2$·sec |
| 2 | 100% Cotton coverall<br>100% Cotton T&B | 4.0 | 3/96/99 | Garment extinguished before completion of data acquisition. |
| 3 | FR Cotton/Nylon blend coverall (88/12), Ultrasoft, 7.0 opsy<br>100% Cotton T&B | 4.0 | 48/18/66 | |
| 4 | Nomex®IIIA coverall, 7.5 opsy<br>100% Cotton T&B | 4.0 | 24/18/42 | |
| 5 | Poly/Cotton blend (65/35) coverall, Weight unknown<br>Nomex®IIIA coverall, 4.5 opsy<br>100% Cotton T&B | 4.0 | 27/58/85 | Garment extinguished before completion of data acquisition. |
| 6 | Nomex®IIIA coverall, 7.5 opsy<br>100% Cotton short sleeve T-shirt<br>100% Cotton Denim jeans<br>100% Cotton T&B | 8.0 | 11/19/30 | |
| 7 | Gas Extraction Suit, Nomex® outershell (7.5 opsy), E-89 lining<br>100% Cotton short sleeve T-shirt<br>100% Cotton Denim jeans<br>100% Cotton T&B | 8.0 | 0/0/0 | Head covered with Kevlar® fabric and PBI headsock. |

101

Fig. 14

EXPLOSION SAFETY GARMENT

CROSS REFERENCE TO RELATED APPLICATIONS

This application claims priority under 35 U.S.C. §119(e) from provisional patent Application No. 60/562,449, filed Apr. 14, 2004. The 60/562,449 Application is hereby incorporated by reference.

This application is a continuation from application Ser. No. 11/104,792 filed on Apr. 13, 2005, which is scheduled to issue as U.S. Pat. No. 7,594,281 on Sep. 29, 2009. The Ser. No. 11/104,792 Application is hereby incorporated by reference.

FIELD OF THE INVENTION

The present invention relates to a suit designed to protect the wearer from explosions and designed to allow remote retrieval of the wearer. The disclosed invention is a protective suit with an internal harness that connects to a flexible tether. The suit also employs an attached respirator tie down that eliminates the need for a second harness, and wrist and ankle closures to stop explosive gasses or other flammable material from entering the interior of the suit and igniting. The suit also employs a removable hood that provides protection from high temperatures, prevents gas buildup in the hood, and can be easily removed.

BACKGROUND OF THE INVENTION

A number of patents have separately dealt with suits to protect the wearer from fires and harnesses to extract the wearer from a dangerous area or retard a fall. The prior art has not integrated a fire and explosion protection suit with a built-in extraction harness.

A number of patents teach safety harnesses. U.S. Pat. No. 2,979,153 to Hoagland et al. teaches the use of an internal harness which tightens onto the limbs of the wearer when used, which could cause further injury to the wearer. U.S. Pat. No. 3,973,643 to Hutchinson teaches a detachable waist harness in a fireman's turn-out coat. U.S. Pat. No. 4,273,216 to Weissmann teaches a harness mounted to the outside of a jacket. U.S. Pat. No. 4,682,671 to Hengstenberger et al. Teaches a harness loop that wraps under the arms and behind the head, and a jacket. U.S. Pat. No. 4,854,418 also to Hengstenberger et al. teaches the same harness and jacket with the addition of a crotch strap. Neither of the Hengstenberger et al. patents teach the use of a full body extraction harness integrated with the interior of a flash suit. It will also be appreciated that the harness loop arrangement of Hengstenberger et al. Is prone to causing neck injuries when in use. U.S. Pat. No. 5,960,480 to Neustater et al. teaches a harness inside a coverall. Like the harness of Hoagland, the harness fits loose most of the time, but cinches tight during a fall. U.S. Pat. No. 6,256,789 to Young et al. teaches a fall arresting harness integrated into a garment, in order to maximize the surface area acted on by the harness. The arrangement of the self-tightening harness is similar to those taught by Hoagland and Neustater et al.

Several patents assigned to E. I. Du Pont de Nemours and Company ("DuPont") relate to fire resistant suits. None of these patents teach the use of an integral extraction harness. U.S. Pat. No. 5,048,124 to Lewis Jr. et al. teaches "Easy Access Protective Coveralls", constructed of a shell to withstand high temperatures and laminated with a liquid impervious layer, and a multilayer liner. U.S. Pat. No. 5,050,241 to Flowers et al. Teaches a multilayer outer shell that has a vapor-permeable, liquid impermeable sheet sandwiched between a woven sheet and an insulating inner layer. U.S. Pat. No. 5,279,287 to Wiseman Sr. teaches a suit, similar to the suit disclosed in Lewis et al., made up of woven fabric with an aluminum layer adhered to it, and includes a detachable head and respirator covering. U.S. Pat. No. 6,490,733 teaches the use of a harness in a pant portion of a suit, but again this would not provides sufficient protection in a closed area where combustible gasses are present and could built up under a suit that was made of two separate garments. U.S. Pat. No. 6,487,725 teaches the storage of a lanyard in the harness, but does not provide for use of the lanyard without obstructing the work of the wearer.

Existing flash protection suits consist of a garment of one layer of flame protective cloth and a separate external fall harness layered on over the garment. The use of an external harness is inconvenient and can cause an explosion if the metal buckles and clips of the harness create a spark. These suits are used in situations where combustible gasses are present or build up, such as inside large pipelines or tanks, and where the risk of explosion is very high. In the case of an explosion, the person wearing the suit must be protected from possible burns due to the high temperatures. In addition, the force of the explosion will often render the person wearing the suit unconscious. The suit must also provide a way to retrieve the person wearing the suit without endangering the lives of those attempting the retrieval. Current suits with integrated harnesses place the harness on the exterior of the suit, which prevents a secure harness attachment to the wearer and allows the harness to shift and move. Moreover, an external harness decreases the effectiveness of the flame proof material by cinching and bunching the garment material against the wearer and thereby decreasing the thickness of the insulating material, squeezing out insulating air pockets, and allowing heat to penetrate the garment more quickly.

At this time there is no garment on the market that addresses the issues of multi-layered flash fire protection, retrievable built-in one-piece harness with lanyard, and respirator hose tie-down, in one protective garment eliminating the need for separate garments and harnesses to protect the worker.

At present, available off the shelve Fire Resistant (FR) Flash/Coverall garments merely meets the three-second test criteria to qualify as Fire Resistant material. These off the shelve single layer FR, natural or aramid, Personal Protective Equipment garments provide some thermal protection for a person engulfed in a gas vapor ignition for less than one to two seconds. Any exposure to the flash-fire over the three-seconds exposes the worker to significant thermal burns to the body and head. Within the field, it is highly desirable and sought-after to provide a flash suit capable of thermal protection for a person engulfed in a gas vapor ignition for at least eight seconds.

Needed is a multi-layer system that will provide added protection to the worker. A multi-layer flash suit must also provide unrestricted movement and comfort compared to single layer garments.

SUMMARY OF INVENTION

The present invention provides an article of clothing that provides protection from high temperatures due to flames, explosions, or combustion. Another purpose of the invention is to provide substantial protection to the wearer from burn injury for an eight second time period. Another purpose of the invention is to allow retrieval of the wearer. Another purpose of the invention is to provide wrist and ankle opening seals to prevent gas or explosive material from building up in the suit and causing an explosion internal to the suit. Another purpose of the invention is to provide an internal harness that will allow remote retrieval of the wearer in case of accident. Another purpose of the invention is the provision of a flash suit that allows retrieval of the wearer from the source of the flames without having to endanger the rescue personnel. Another purpose of the invention is to provide an internal harness that cannot cause sparks and create the risk of explosion. Another purpose of the invention is to provide an integrated respirator tie down so that an additional harness is not needed. Another purpose of the invention is to provide a removable hood that protects the head and neck of the wearer from burns, but does not allow gas build up in the hood. Another purpose of the invention is to provide a storage pouch for a flexible retrieval lanyard so that the lanyard can be easily stored with the suit. Another purpose of the invention is to provide a grounding lead to the suit, further preventing the possibility of spark in the hazard area.

BRIEF DESCRIPTION OF DRAWINGS

FIG. 1*a* is a front view of the flash suit of the present invention, showing the front closure and closure tabs.

FIG. 1*b* is a detailed front view of the upper torso portion of the flash suit, showing the opened front.

FIG. 11 shows detail of a Nomex® wrist or ankle closure tab.

FIG. 12*a* shows the respirator tie down D-ring.

FIG. 12*b* shows the Nomex® reinforcement panel used to secure the respirator tie down D-ring.

FIG. 14 shows test results.

DETAILED DESCRIPTION OF SPECIFIC EMBODIMENTS

Figure 2:
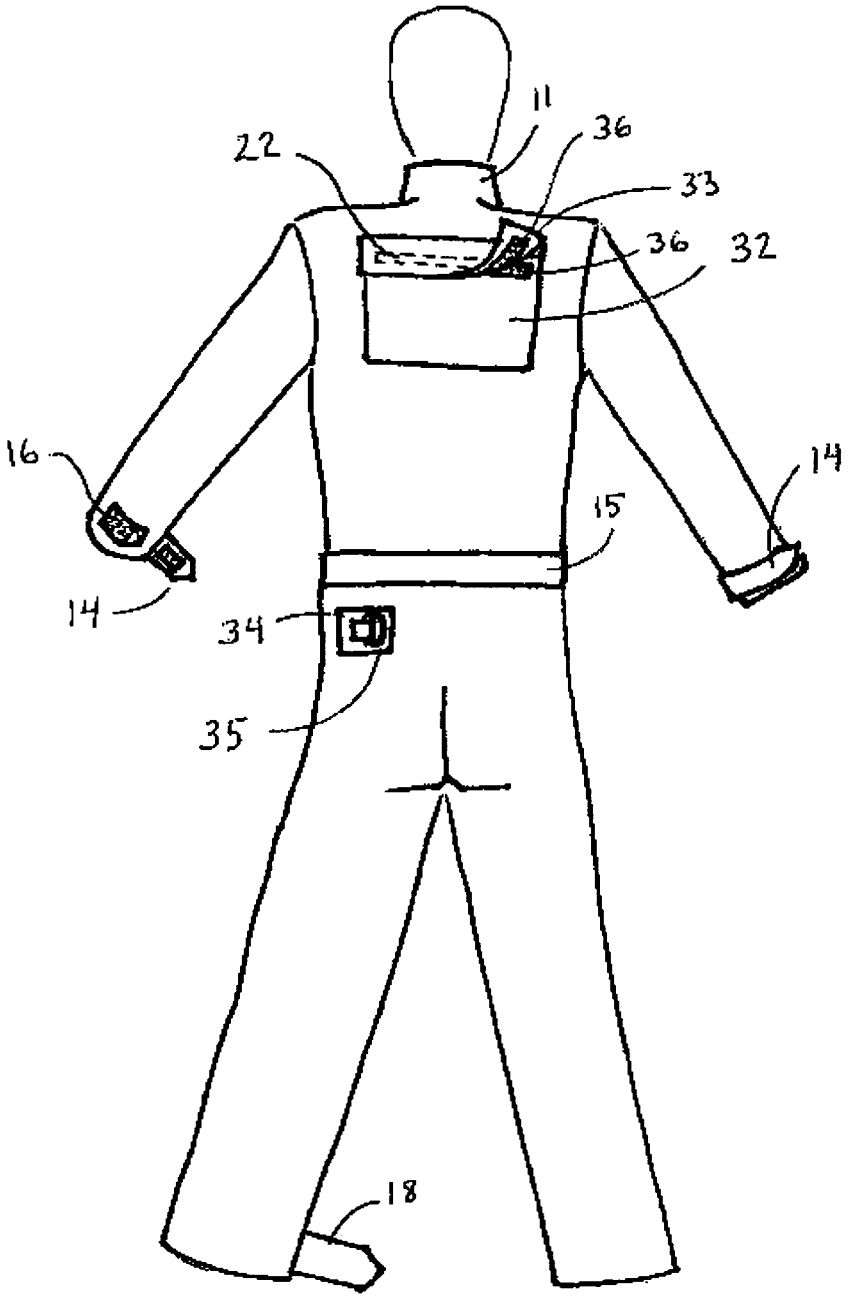
FIG. 2 is a rear view of the flash suit, showing the rear external features of the suit, including the lanyard pouch, respirator D-ring attachment and closure tabs.

FIG. 1*a* shows a front view of the flash suit 1. The garment is a single-piece suit having a torso portion 10, an opening collar 11, a front opening 12, arms 13, wrist closure tabs 14, waistband 15, legs 17, ankle closure tabs 18, and a hook-and-loop panel 16 mounted on the ankle. The hook-and-loop panels described herein are complimentary panels of hook panels and loop panels which, when pressed together, stick together. These hook-and-loop fasteners are commonly referred to by the trademark "Velcro". In this application, the choice of hook or loop panel for a particular closure is not important, so the complimentary panels are referred to by the same reference number, 16. The wrist closure tab 14 is placed near the end of the arm or sleeve 13, and by pulling the tab 14 and fastening it to its respective panel 16 (the wrist panel 16 is not seen from the front of the garment and is not shown in FIG. 1, but may be seen in FIG. 2), the wrist portion of the sleeve 13 may be wrapped tightly around the wearer's wrist. Similarly, the ankle tab 18 is located at the bottom of the garment's trouser leg 17 and may be pulled and fastened to a panel 16 on the leg 17, thereby tightly wrapping the ankle portion of the leg 17 around the wearer's leg. By providing these closure tabs, 14 and 18, the suit can restrict gases from entering the interior of the garment. The danger of a gas build-up in the interior of a flash suit is that, should and explosion or fire take place, the gases inside the suit could be ignited. The hook-and-loop panels 16 are constructed from a fire resistant material capable of withstanding high heat without melting are catching fire. One such commercially available product is Aplix® #820 hook and loop from Aplix Inc. The hook panel is constructed of a woven fire resistant base, such as the Nomex® manufactured by E.I. Du Pont de Nemours and Company. The Nomex® material is discussed in more detail below, in connection with the materials used to construct the outer shell of the flash suit 1. Atop the Nomex® base of the hook panel are mounted 6.5 mil nylon monofilament hooks. The loop panel is constructed of a woven Nomex® base, atop which is mounted unnapped Nomex® hoops. The described hook-and-loop material is non-flammable and non-melting. Each of the panels is individually resistant to high temperatures and, when fastened together, are resistant to higher temperatures. As shown in FIG. 11, the closure tabs, 14 and 18, are constructed of two layers of fire resistant 7.5 oz Nomex® Yellow Tab fabric, stitched together, turned and top stitched. A loop panel 16, constructed as described above, is sewn to the tab, 14 or 18.

FIG. 1*b* shows detail of the front opening 20 of the suit 1. The opening 20 extends down from the collar 11 and provides an opening sufficient to allow the wearer to put on and take off the suit with ease. Preferably, the opening 20 extends below the waistband 15 to a point near the wearer's crotch, which affords convenient access and day-to-day practicality. A zipper 21 allows the opening 20 to be securely closed and easily opened. The zipper is 21 preferably a heavy duty, number 10, nylon, one-way zipper. A storm flap 12 is provided on the exterior of the torso portion 10 to create a seal over the zippered opening 20. The storm flap 12 has a hook-and-loop strip 22 mounted to the interior of the flap 12. A complimentary hook-and-loop strip 23 is mounted to the torso 10, so that, when pressed together, the flap 12 will be securely sealed to the torso 10. As described above with respect to the wrist and ankle closure tabs, 14 and 18, the hook-and-loop strips, 22 and 23, should be of a non-flammable and non-melting construction, such as the Aplix® #820 hook & loop product. When properly sealed, the storm flap 12 restricts gases and flames from entering the suit. The collar 11 is also provided with a hook-and-loop fastener to seal the collar 11 around the wearer's neck. A "Nero" collar 11 is formed when the collar's closure tab 19 fastens over the collar. The tab 19 has a non-flammable and non-melting hook-and-loop panel 24 on its interior surface which secures to a complimentary panel 25 on the collar. As with the wrist and ankle tabs, 14 and 18, the collar tab 19 can seal over the wearer's neck and restrict the entry of gases and flames.

Figure 8B:
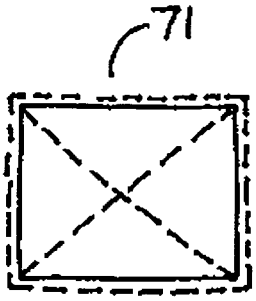
FIG. 8*b* shows detail of a box stitch used in the harness and other portions of the flash suit.
Figure 10:
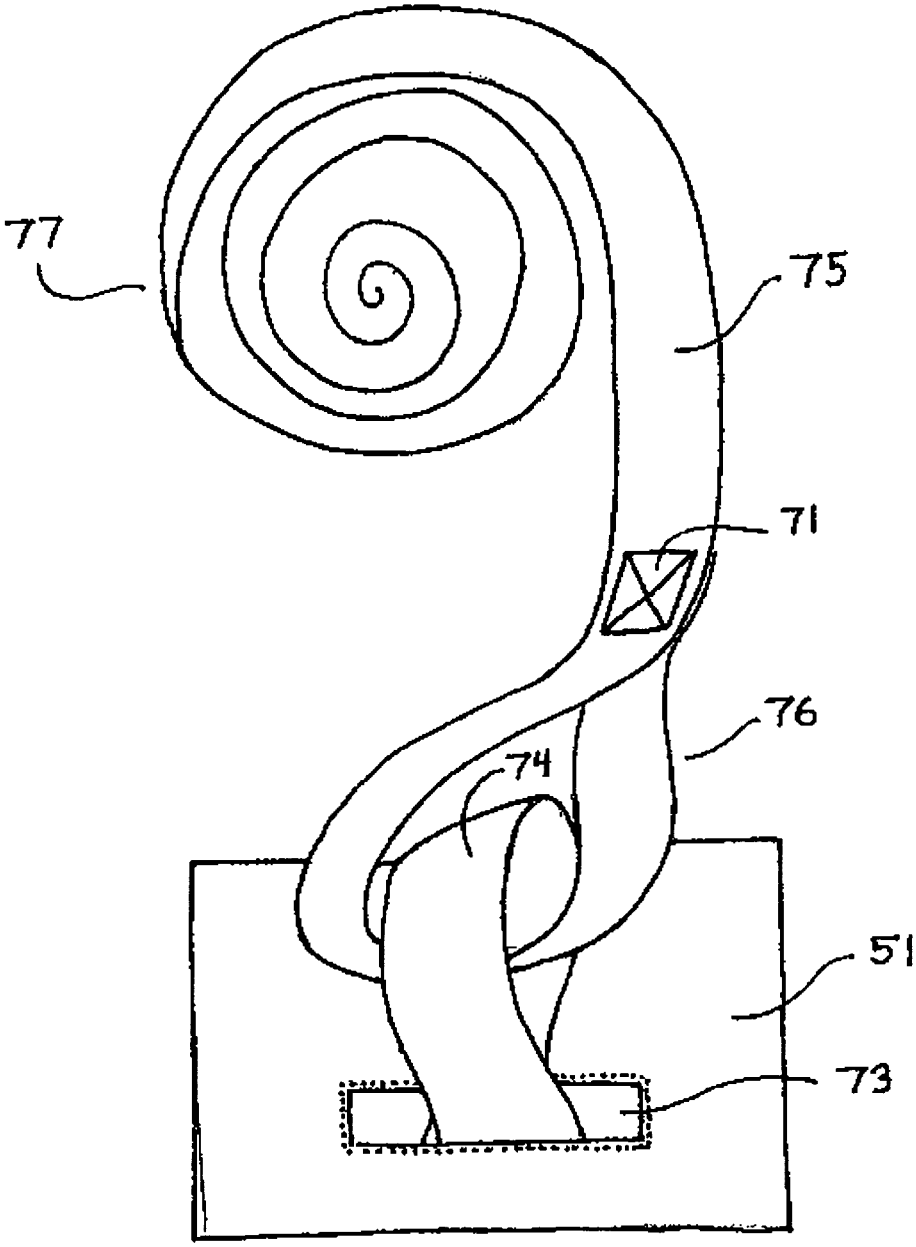
FIG. 10 shows detail of the lanyard attachment loop exiting from the back reinforcement panel, the lanyard attached to the lanyard attachment loop, and shows the lanyard coiled in a manner for storage in the lanyard pouch.

FIG. 2 shows the rear, exterior portion of the suit 1. On the upper portion of the rear torso 10, an exterior pouch 32 is provided for storing an emergency remote retrieval lanyard 75. The pouch is closed with a upper flap 33, and the flap is sealed with complimentary non-flammable and non-melting hook-and-loop panels 36, such as the type described above. The construction of the harness 61 (as seen, e.g., in FIG. 6), and lanyard 75 (as seen in FIG. 10), are described in greater detail below. The pouch 32 is designed to store a lanyard 75. For example, as seen in FIG. 10, a woven lanyard 75 may be coiled 77 for storage in the pouch 32. Lower on the rear portion is a tie-down D-ring 35 mounted on a D-ring panel 34. The tie-down ring 35 is suitable for securing a respirator (not shown), and is also suitable as a grounding point to prevent the build-up of static electricity. As seen in FIG. 12*a*, the tie-down ring may be formed of a D-ring 35 held by a non-flammable and non-melting web strap 36. Preferably, the strap 36 is constructed of commercially available two-inch natural Kevlar® webbing, having a thickness of about 0.062 inch, a weight of about 1.8 ounces per yard, a ground warp count of type 964 Kevlar® and Kevlar® catchcord of about 272, a binder warp count of type 964 Kevlar® of about 62, and breaking strength of about 7,300 pounds. Kevlar® is described in U.S. Pat. No. 5,050,241 as poly(p-phenylene terephthalamide) fiber, and is commercially available from E. I. Du Pont de Nemours and Company. Kevlar® has properties of high strength and fire resistance. The tie-down ring strap 36 is held in place by a tie-down panel, as seen in FIG. 12*b*. The strap is sewn together 80 to form a loop to hold the D-ring 35. Upper and lower ends of the strap, 78 and 79, are box X stitched 71 to the panel 34. FIG. 8*b* shows an exemplary box X stitch. Between the waistband panel 15 of the outer suit 10 and the tie-down panel 34, the upper end of the strap 78 is secured with box X stitch 71, the lower end of the strap 79 is secured with box X stitch 71, and the loop 36 emerges from the tie-down panel 34 from slot 81. The tie-down panel 34 is stitched to the suit 10. The tie-down ring 35 is available for securing a piece of equipment, such as a respirator, and eliminates the need for a separate harness. The elimination of external harnesses increases the fire protection effectiveness of the suit 1. When an external harness is present, the material of the suit 1 is bunched together and compressed underneath the harness. As noted above, an external harness decreases the effectiveness of flame proof material by cinching and bunching the garment material against the wearer, thereby decreasing the thickness of the insulating material, squeezing out insulating air pockets, and allowing heat to penetrate the garment more quickly. Thus, use of the integrated tie-down ring 35 eliminates the need for an additional external harness and increases the fire protective ability of the suit 1.

Figure 3A:
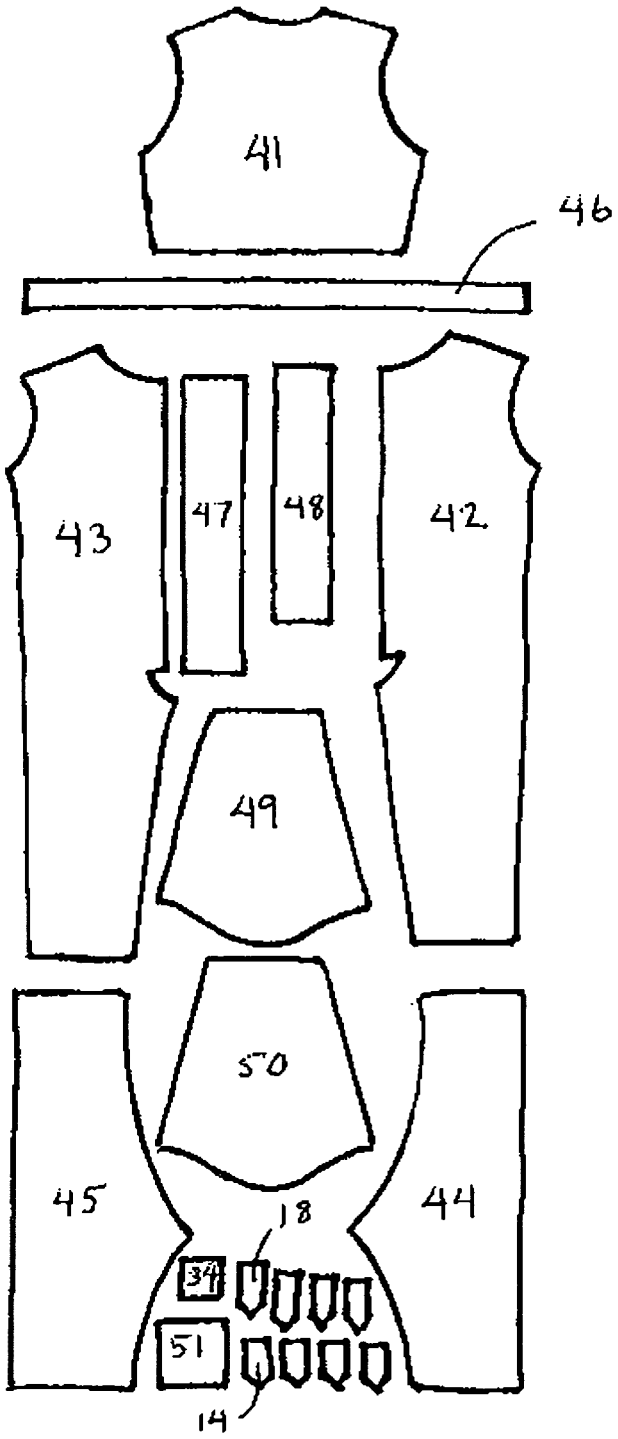
FIG. 3*a* is a scaled drawing of an exemplary pattern used in making the individuals panels of the outer shell of the flash suit.

FIG. 3*a* shows a pattern for the panels that make up the outer shell of flash suit 1. The panel's are taken from a fire-resistant material, preferably Nomex® IIIA® 7.5 ounce per square yard ("ospy"), or Nomex® 7.5 ospy. Nomex® is described in U.S. Pat. No. 5,050,241 as poly(m-phenylene isophthalamide) fiber, and is a trademarked material owned by E. I. Du Pont de Nemours and Company ("Du Pont") and commercially available. As more fully described in U.S. Pat. No. 6,132,476 to Lunsford et al., the Nomex® fibers are an aromatic polyamide, which are formed by reactions of aromatic diacid chlorides with aromatic diamines to produce amide linkages in an amide solvent, and referred to by the generic term aramid fiber. Aramid fibers are typically available in meta-type fibers composed of poly(m-phenylene isophthalamide), referred to as meta-aramid fibers, and para-type fibers composed of poly(p-phenyleneterephthalamide), referred to as para-aramid fibers. Meta-aramid fibers are currently available from Du Pont in several forms under the NOMEX® trademark. NOMEX IIIA®, sometimes referred to as NOMEX T-462®, is 93% NOMEX®, 5% KEVLAR®, and 2% carbon core nylon. The 7.5 opsy NOMEX IIIA® provides fire resistance and light weight. Referring again to FIG. 3*a*, Panel 41 is the rear portion of the outer torso 10. Panel 46 is the waistband 15. Panel 43 is one side of the front outer shell torso 10 and leg 17, and panel 42 is the other side. Panel 48 is the collar 11. Panel 47 is the storm flap 12. Panels 49 and 50 are the arm or sleeve portions 13. Panel 44 is the rear portion of one of the legs 17, and panel 45 is the rear portion of the other leg. Panel 34 is the tie-down panel. Panel 51 is the back reinforcement panel. Panels 14 and 18 are each halves of the tab closures.

Figure 3B:
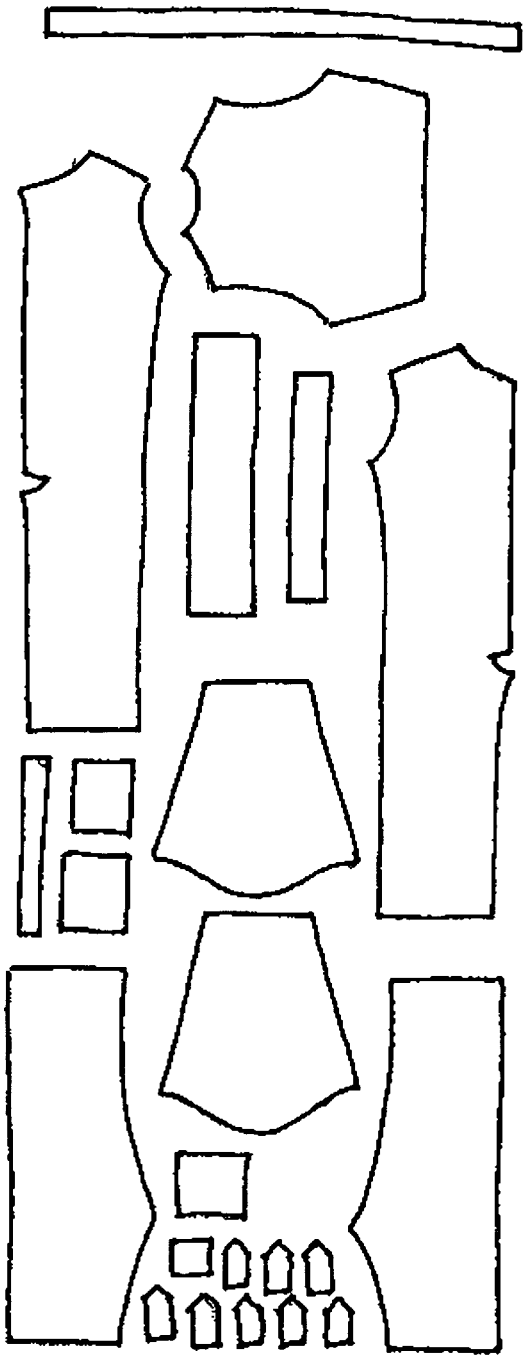
FIG. 3*b* is a scaled drawing of an alternative exemplary pattern used in making the individuals panels of the outer shell of the flash suit.

FIG. 3*b* shows an alternative pattern for the panels that make up the outer shell of flash suit 1. It will be appreciated to those familiar with the construction of garments, that the patterns shown in FIGS. 3*a* and 3*b* allow each of the panels to be cut from a single sheet of material. Many alternative patterns are possible.

Figure 4:
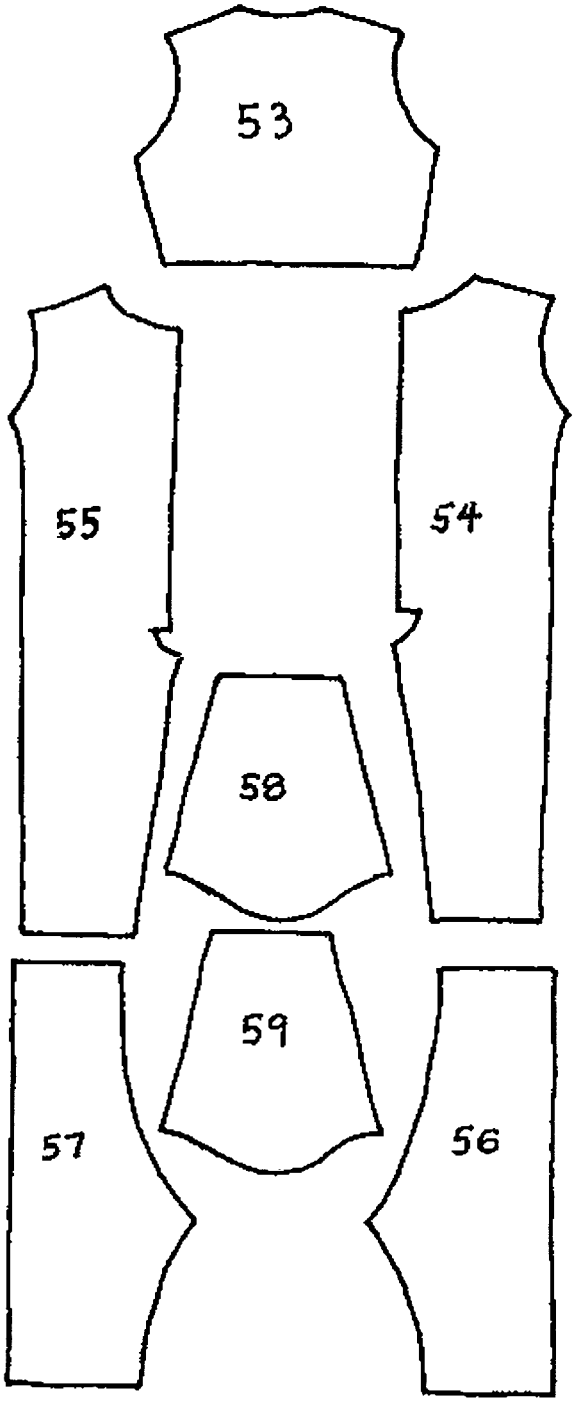
FIG. 4 is a scaled drawing of an exemplary pattern used in making the individual panels of the interior liner of the flash suit.

The flash suit 1 is constructed of an outer shell, as seen in FIGS. 1*a* through 3*b*, and an inner liner, as seen in the pattern shown in FIG. 4. The inner liner is constructed from panels of thermal insulating material, such as 3-layer E-89® NOMEX®/KEVLAR® quilted fabric, a mixture of meta-aramid and para-aramid fibers, commercially available from DuPont. Panel 53 is the rear portion of the inner liner torso 10. Panel 54 is one side of the front inner liner torso 10 and leg 17, and panel 55 is the other side. Panels 58 and 59 are the arm or sleeve portions 13. Panel 56 is the rear portion of one of the legs 17, and panel 57 is the rear portion of the other leg. As with the pattern shown in FIG. 3*a*, it will be appreciated to those familiar with the construction of garments, that the pattern shown in FIG. 3*a* allows each of the panels to be cut from a single sheet of material. Many alternative patterns are possible.

FIGS. 5 through 9*a* show the interior, integral harness 61. The harness 61 is constructed from 6000 psi nylon seat belt webbing sewn with KEVLAR® thread. All high stress areas of the harness 61 are sewn with double box X stitches 71 (as seen in FIG. 8*b*). The harness 61 extends outside of the suit through slot 73 in back reinforcement panel 51. The segment of harness that protrudes from the suit is constructed of natural KEVLAR® webbing, as described above with respect to the tie-down web strap 35.

Figure 5:
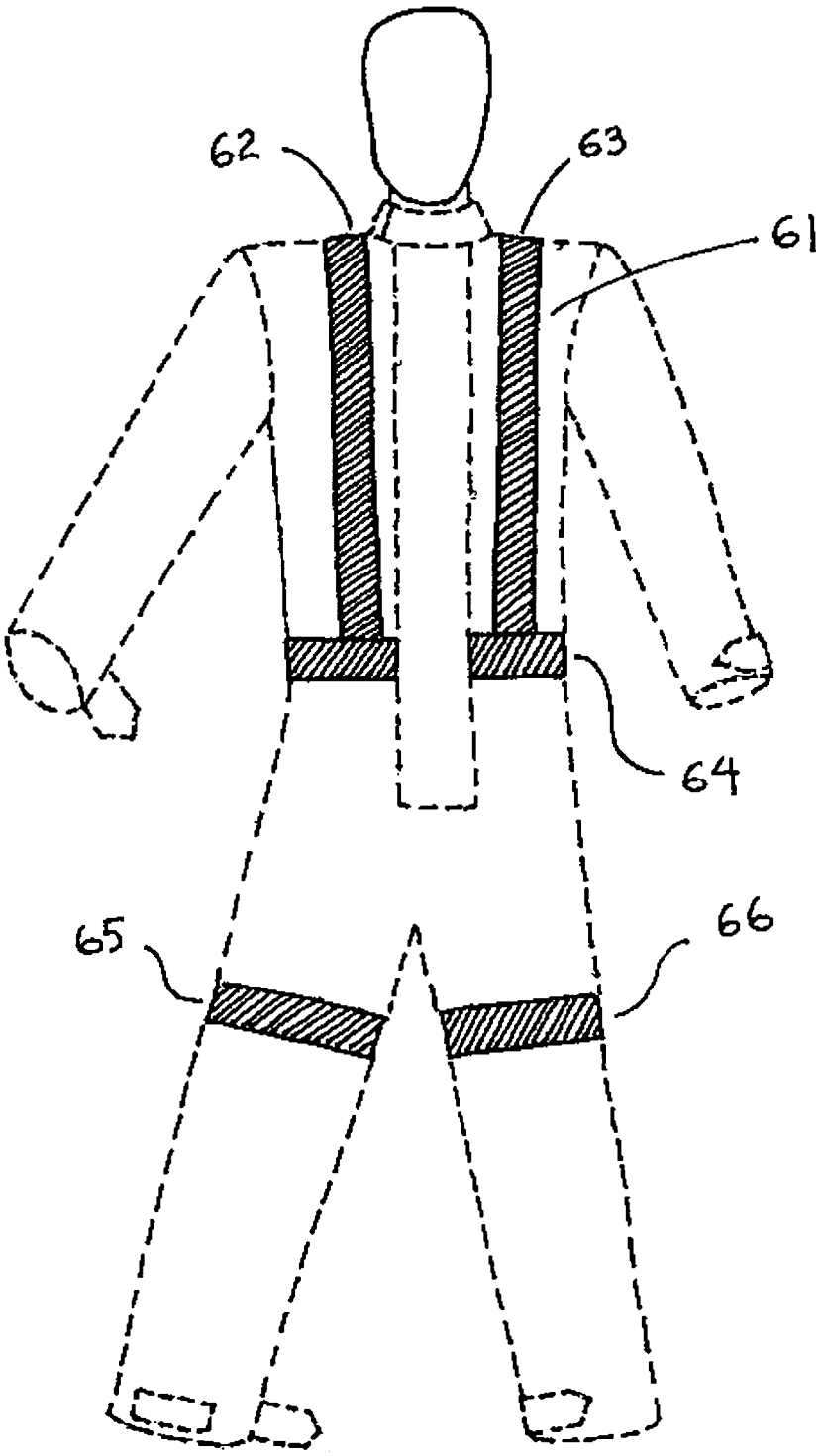
FIG. 5 shows the harness incorporated into the front portion of the interior of the flash suit (shown in ghost).

FIG. 5 shows a front view of the harness 61. A right-side strap 62 runs over the right shoulder and straight down to the waist, meeting the waist strap 64 on the right side from the middle of the torso 10. Symmetrically, the left-hand strap 63 runs over the shoulder on the left side. A right leg band 65 encircles the right thigh of the leg 17, and a left leg band 66 encircles the left thigh.

Figure 6:
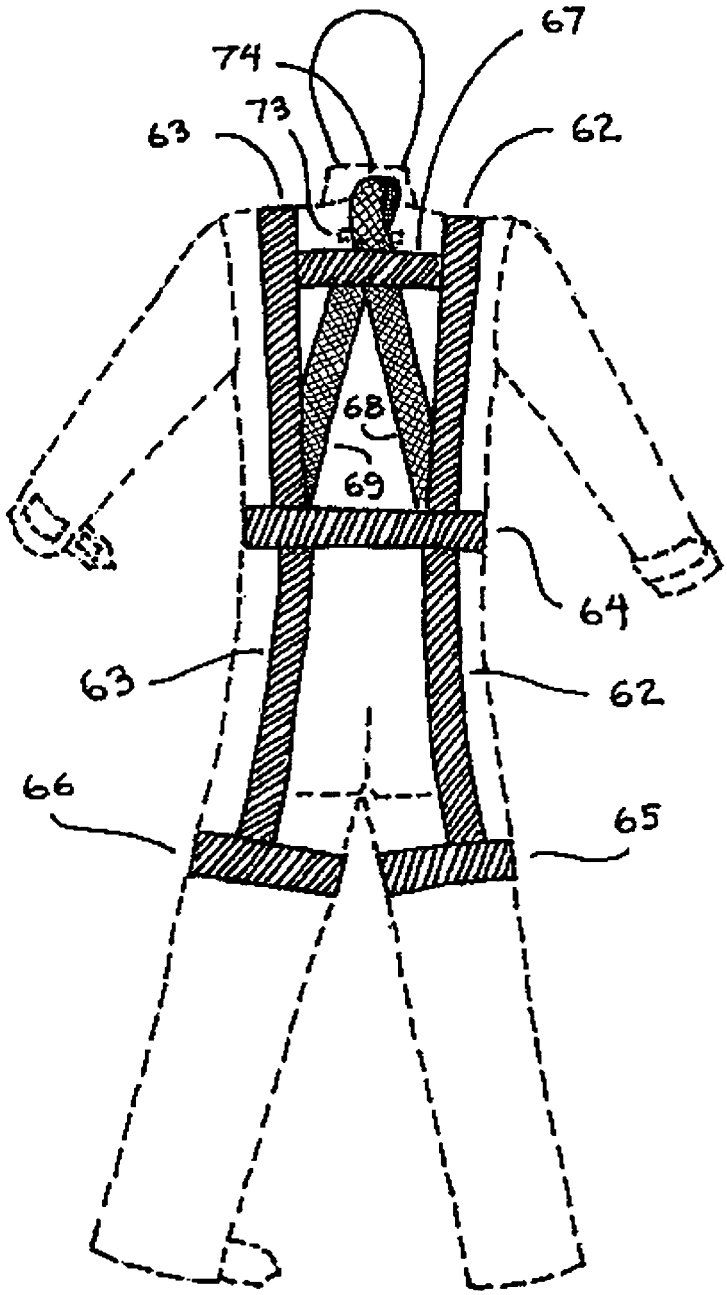
FIG. 6 shows the harness incorporated into the rear portion of the interior of the flash suit (shown in ghost).

FIG. 6 shows a rear view of the harness 61. The right-side strap 62 and left-side strap 63 run over the shoulders and straight down, past the waist strap 64, and down to the thigh bands, 65 and 66. An upper back reinforcement strap 67 runs horizontally across from the right and left shoulder straps, 62 and 63. A right-side reinforcement strap 68 runs diagonally from the point where the right-side strap 62 meets the waistband 64 up to the upper reinforcement strap 67, then out through slot 73 to the exterior of the suit where it folds over on itself to form a loop 74, then runs back down diagonally to the point where the left-side strap 63 meets the waistband 64. The double cross-hatching of the loop 74 and reinforcement straps 68 and 69 indicates that these portions of the harness 61 are constructed of fire-resistant Kevlar® webbing material. A left-side reinforcement strap 69 runs from the middle of the upper back strap 67 diagonally down to the point where the left-side strap 63 meets the waistband 64.

Figure 7:
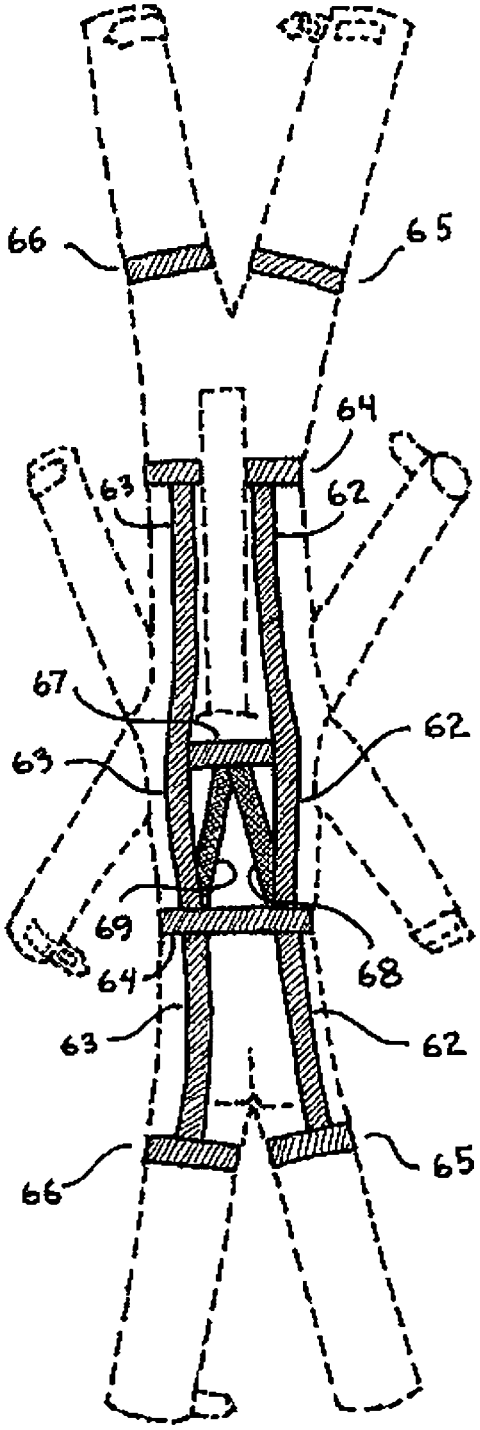
FIG. 7 shows the harness incorporated continuously into the front and rear portions of the flash suit (shown in ghost).

FIG. 7 provides a view of the harness 61 with the front and rear portions of the suit 1 spread open. This figure shows the continuous construction of the right and left straps, 62 and 63. This figure shows how the right and left straps, 62 and 63, run from the waist strap 64 in the front, over the shoulders, past waist strap 64 in the rear, and down to the leg bands 65 and 66.

Figure 8A:
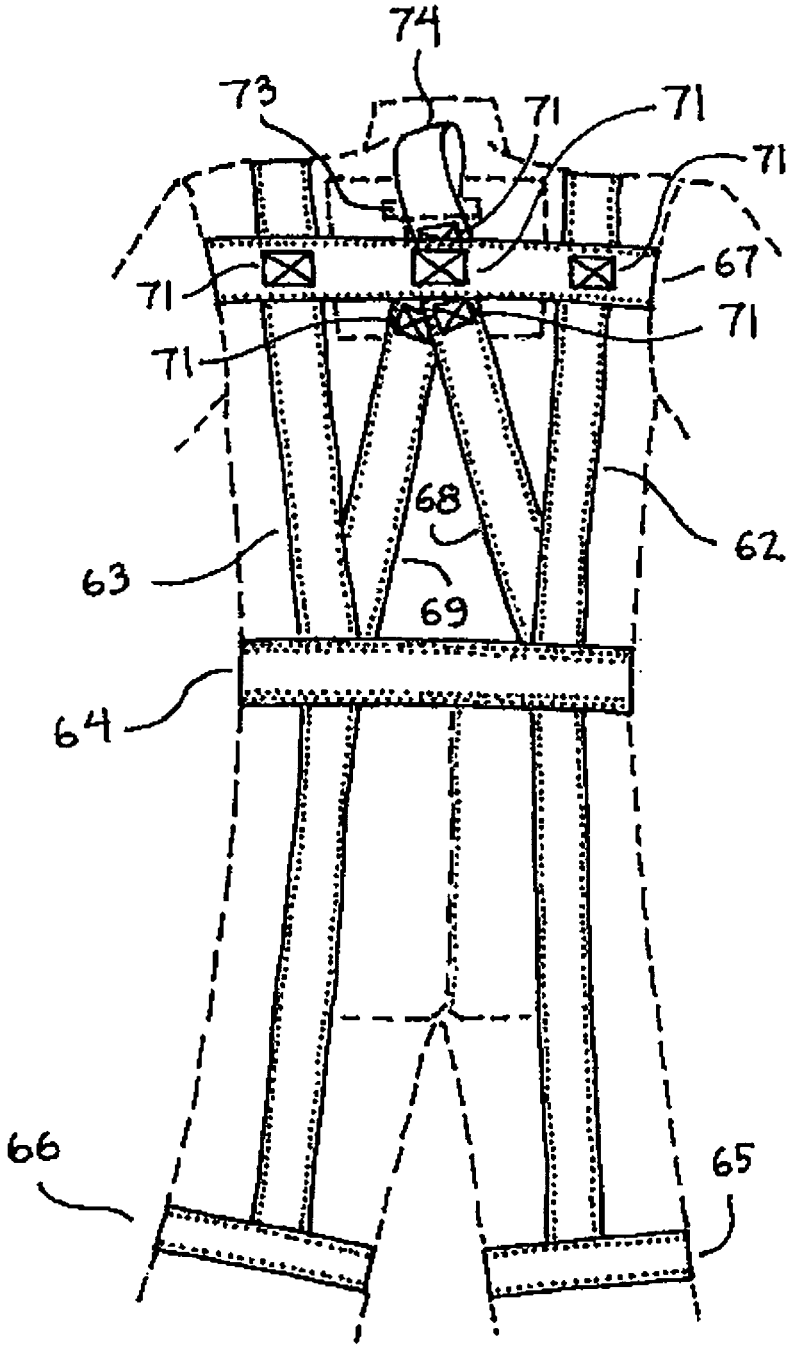
FIG. 8*a* shows detail of the harness incorporated into the rear portion of the flash suit (shown in ghost), including the detail of the box stitch used in securing portions of the harness.
Figure 9A:
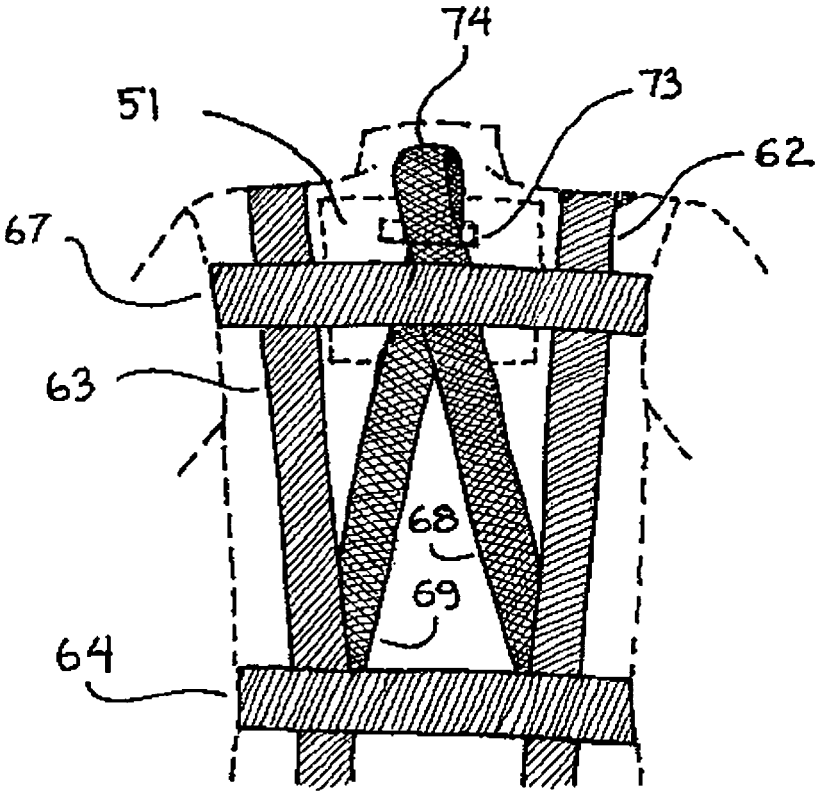
FIG. 9*a* is an exterior rear portion view showing detail of the back reinforcement panel, mounted to the rear portion of the flash suit (shown in ghost), allowing the harness to exit the garment to form a lanyard attachment loop, and showing the lanyard attachment loop exiting from the back reinforcement panel (shown in ghost).
Figure 9B:
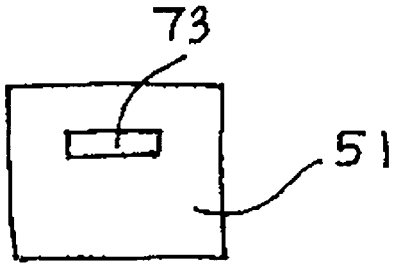
FIG. 9*b* shows detail of the back reinforcement panel.

FIGS. 8*a* and 8*b* show how high-stress points in the harness 61 are reinforced by double box X stitching. Thus, where the right and left straps, 62 and 63, meet the upper back reinforcement strap 67, double box X stitching 71 reinforces the junctions. Also, where the right and left diagonal reinforcement straps, 68 and 69, approach the upper back strap 67, double box X stitching reinforces the harness 61 at the back reinforcement panel 51. Also, where the right and left diagonal straps, 68 and 69, meet the upper back strap 67, double box X stitching reinforces the junction. Finally, it can be seen that, where the harness exits rear portion of the suit 1 through slot 73, double box X stitching fastens the right and left diagonal straps, 68 and 69, so that they form a harness loop 74 (seen in FIG. 9*a*). As noted above, this harness loop portion 74 is constructed of natural KEVLAR® webbing, as described above with respect to the tie-down web strap 35. Referring to FIG. 9*a*, it may be seen that the harness loop 74 exits the interior of the suit 1 through slot 73, located near the shoulder blades of the wearer. A back reinforcement panel 51 on the interior of the suit provides additional strength at the point where the harness 61 exits the slot 73. From FIG. 9*b* it will be seen that the back reinforcement panel 51 is an eight inch square piece. The slot 73 is a rectangle, two-and-a-half inches by three-quarters of an inch in dimension, which is sewn and topstitched, including topstitching around the edges. The slot 73 is located high at the rear of the torso 10 so that pulling forces from a lanyard 75 (not shown in FIG. 9*a*) are exerted to the harness loop 74 then to the harness 61, thereby pulling suspending the wearer from a point near the head. The harness 61 distributes forces to the thighs, waist and chest. If dragged by a lanyard 75, the wearer will be pulled head first, which is the most efficient manner in emergency operations for which the suit 1 is designed. The harness 61 and loop 74 arrangement prevents the wearer from being dragged or suspended sideways, which may injure the wearer and increase the likelihood that the wearer will get stuck when being pulled or dragged.

FIG. 10 shows the connection of the harness loop 74 and lanyard 75. One end of the lanyard is threaded through the harness loop 74, then made to form its own loop 76 by folding it over and stitching it with a double box X stitch 71 to the lanyard 75. As described above, FIG. 11 shows how the lanyard 75 may be stored in the rear pouch 32 (not shown) by coiling 77 the lanyard.

Figure 13:
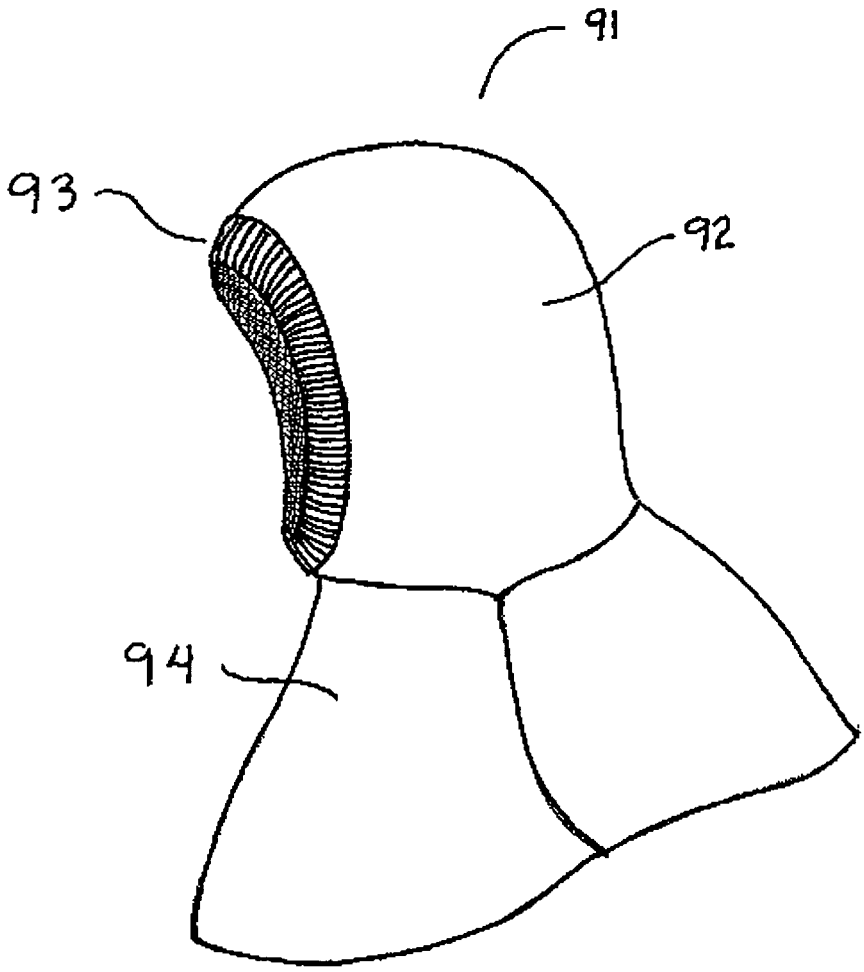
FIG. 13 is a side view of the detachable hood of the retrievable flash suit.

FIG. 13 shows the detachable Hood 91, which consists of double layered NOMEX® knit around the face opening 93, a three layer hood 92, described below, and a single layer NOMEX® drape 94 which covers the shoulders of the wearer. The hood 92 has three layers: an outer layer formed of NOMEX® knit, a middle layer formed of 3-layer E-89® Nomex®/Kevlar® quilted, and an inner layer of PBI® knit (all commercially available from DuPont). It has been discovered that a separate hood has advantages of suits with integral hoods. Most significantly, the separate hood prevents the build up of flammable and explosive gases inside the suit 1, thereby decreasing the risk of ignition within the suit. The separate hood 91 may be used with convention face protection and is easily put on and taken off.

FIG. 14 shows a table of test results 101 for the flash suit 1 of the disclosed invention, as well as test results for currently available flash suits and test results without protective clothing (nude burn, cotton clothing, and cotton/nylon blends of clothing). The table indicates the time, in seconds, the test lasted and the percentage of $2^{nd}$ and $3^{rd}$ degree burns, as well as the total percentage of burning. The test results showed that the flash suit construction of the disclosed invention lasted 8 seconds without any burning reaching the inside of the suit. This result surpassed all other commercially available flash suits.

The drawings and description set forth here represent only some embodiments of the invention. After considering these, skilled persons will understand that there are many ways to make a flash suit according to the principles disclosed. The inventors contemplate that the use of alternative structures, materials, or manufacturing techniques, which result in a flash suit according to the principles disclosed, will be within the scope of the invention.

We claim:

1. An explosion and fire safety suit with integral extraction harness comprising:

a multi-layer coverall formed of a fire-resistant exterior material and an interior material specifically adapted to insulate from very high heat, said coverall having a torso, collar, shoulders, arms, waist, legs, thighs, an inner side on an inward-facing side of the interior material, an outer side on an outward-facing side of the exterior material, and front and back sides, and a harness disposed on the inner side and integral with the coverall, said harness comprising thigh bands at each thigh, a waistband at the waist, shoulder straps configured to extend from the thigh bands and over the inner side of said shoulders to the waistband, and a harness connection point attached to the harness and extending out of the suit.

2. The explosion and fire safety suit with integral extraction harness of claim 1 further comprising a detachable multi-layer hood comprising a hood outer layer, a hood middle layer, and a hood inner layer, wherein the hood outer, middle and inner layers are constructed of fire resistant material.

3. The explosion and fire safety suit with integral extraction harness of claim 1 wherein each of said arms further comprises a wrist opening and a releaseable wrist tab configured to cinch the wrist opening around a wrist, and wherein each of said legs further comprises an ankle opening and a releaseable ankle tab configured to cinch the ankle opening around an ankle, and wherein the collar further comprises a collar opening and a releaseable collar tab configured to cinch the collar opening around a neck, and wherein the torso further comprises a zippered torso opening and a releaseable torso opening flap over the torso opening.

4. The explosion and fire safety suit with integral extraction harness of claim 3 wherein the wrist, ankle, collar and torso openings further comprise fire resistant hook-and-loop material comprising a loop base formed of a woven aromatic polyamide base and unnapped aromatic polyamide hoops extending up from said loop base, and wherein the releaseable wrist tab and releaseable ankle tab and releaseable collar tab and releaseable torso opening flap further comprise fire resistant hook-and-loop material comprising a hook base formed of aromatic polyamide material and hooks extending up from said hook base.

5. The explosion and fire safety suit with integral extraction harness of claim 1 further comprising a tie-down connector.

6. The explosion and fire safety suit with integral extraction harness of claim 5 wherein the tie-down connector further comprises a metal D-ring secured to the back side of the coverall by a fire resistant strap.

7. The explosion and fire safety suit with integral extraction harness of claim 1 further comprising a lanyard constructed of a fire resistant material and connectable to the harness connection point.

8. A flash suit with integral extraction harness comprising:

a multi-layer coverall having an exterior and an interior, and comprising an exterior material and a second material interior of the exterior material, wherein said exterior material is composed of material resistant to direct exposure to flame and high heat, said exterior material formed of aromatic polyamide meta-aramid fibers, and wherein said second material is composed of a material that insulates said interior from said flame and high heat, said second material formed of at least aromatic polyamide para-aramid fibers;

said coverall having a torso, collar, shoulders, arms, waist, legs, thighs; and a harness disposed on said interior of and integral with said coverall, said harness comprising thigh bands at each thigh, a waistband at said waist, shoulder straps configured to extend from said thigh bands and over the interior of said shoulders to said waistband, and a harness connection point attached to the harness and extending out of the suit.

9. The flash suit of claim 8 further comprising an integral hood extending up from said collar, wherein said hood comprises a hood exterior and a hood interior, and comprising a hood exterior material and a third material interior of said hood exterior material, wherein said hood exterior material is composed of material resistant to direct exposure to flame and high heat, and wherein said third material is composed of a material that insulates said interior from said flame and high heat.

10. The flash suit of claim 8 further comprising a multi-layer detachable hood having a hood exterior material and a hood interior material is composed of material resistant to direct exposure to flame and high heat, wherein said hood exterior material is formed of aromatic polyamide meta-aramid fibers and said hood interior material is formed of at least quilted aromatic polyamide fibers.

* * * * *